United States Patent [19]

Sidelman

[11] 4,210,164

[45] Jul. 1, 1980

[54] SELF-HOLDING HAIR ROLLERS

[75] Inventor: Abraham Sidelman, Manchester, Ga.

[73] Assignee: H. Goodman & Sons, Inc., Kearny, N.J.

[21] Appl. No.: 880,626

[22] Filed: Feb. 23, 1978

[51] Int. Cl.[2] ..... A45D 2/00

[52] U.S. Cl. ..... 132/40

[58] Field of Search ..... 132/40, 41, 42

[56] References Cited

U.S. PATENT DOCUMENTS

| | | | |
|---|---|---|---|
| 3,123,080 | 3/1964 | Brenn-Albertoni | 132/40 |
| 3,267,942 | 8/1966 | Mestral | 132/40 |
| 3,556,114 | 1/1971 | Simon | 132/40 |
| 3,624,749 | 11/1971 | Girard | 132/40 |

FOREIGN PATENT DOCUMENTS

| | | | |
|---|---|---|---|
| 1457375 | 3/1969 | Fed. Rep. of Germany | 132/40 |
| 1335844 | 7/1963 | France | 132/40 |

*Primary Examiner*—G. E. McNeill

[57] ABSTRACT

Novel hair rollers have resilient monofilaments formed as detents projecting in pairs from a self-supporting cylinder wall. The detents individually have an upstanding leg and an overhang which projects from the leg to be disposed over an opposite area of the cylinder wall. The pairs of detents have their overhangs extending toward each other and disposed at slant angles to planes perpendicular to the axis of the roller, the legs of each pair being spaced by the combined lengths of their overhangs.

7 Claims, 8 Drawing Figures

FIG. 1
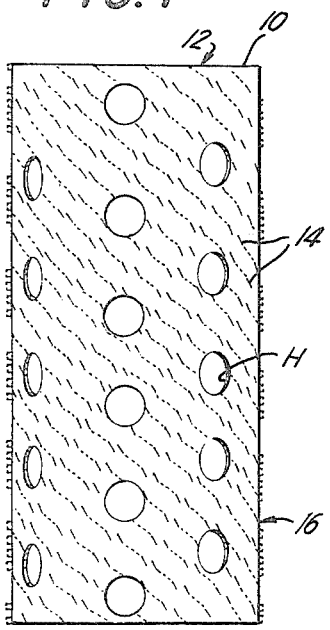
FIG. 3
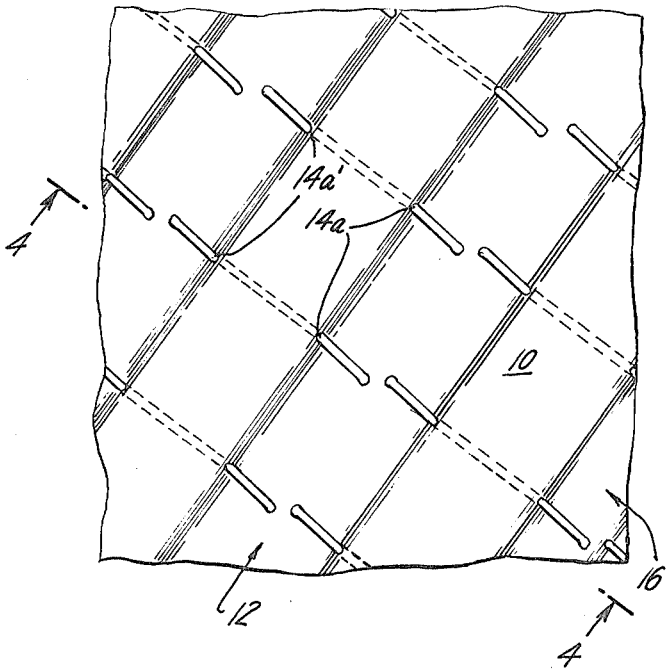
FIG. 2
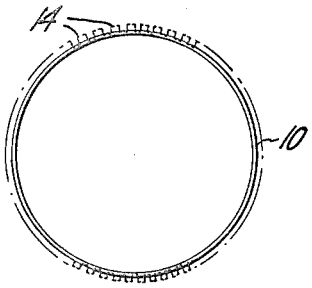
FIG. 5
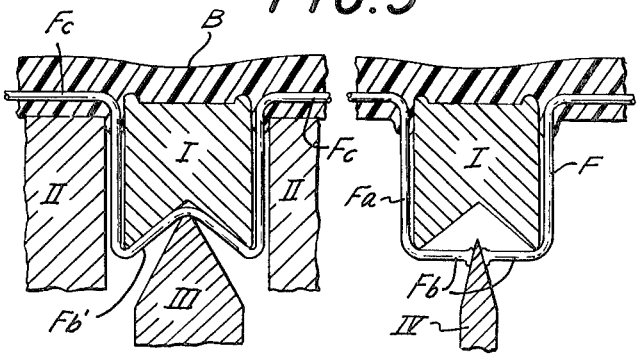
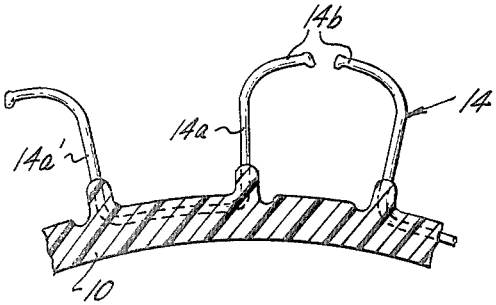
FIG. 4
FIG. 6
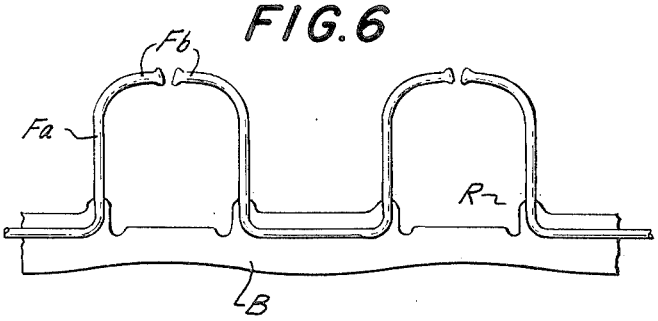
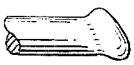
FIG. 4a
FIG. 7
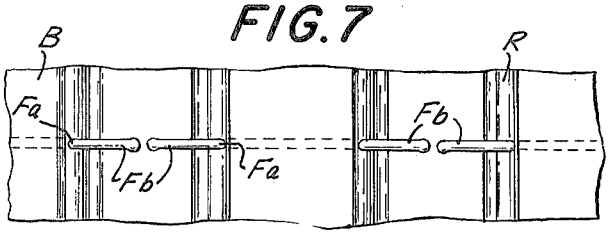

SELF-HOLDING HAIR ROLLERS

BACKGROUND OF THE INVENTION

The present invention relates to hair rollers, particularly to hair rollers of the type having bristles designed to hold the roller wound in a lock of hair without resort to supplementary fasteners such as clips or bobby pins.

A variety of hair rollers of this kind are known. One such roller is disclosed in U.S. Pat. No. 3,556,114 issued Jan. 19, 1971 to S. M. Simon and assigned to the assignee hereof. Such rollers achieve their purpose effectively, but have shortcomings. Rollers as described in the Simon patent have a cylinder of plastic material from which many hair-retainers project. Those retainers are made of monofilaments of nylon formed into base loops embedded in the cylinder wall and projecting loops, and one leg of each projecting loop is cut by a sharp blade, thus forming a retainer and a stub. The hair retainer adjacent the stub has proved to be so secure as to make it sometimes difficult to remove the roller from the wearer's hair. The short stub projecting outward of the cylinder wall of the roller is irritating when the roller is pressed against the wearer's head, and irritating to the user's hands when manipulating the roller.

Other hair rollers are known having variously shaped bristles intended to render the rollers self-retaining. For example, rollers have been proposed having projecting elements on a cylinder, all of one-piece molded plastic. (See German Gebrauchsmuster No. 1,800,352.) However, it is evidently difficult if not impossible to mold such elements thin enough to simulate yielding filaments, and it is all-but-impossible to mold vast numbers of such elements projecting from the cylinder in all directions outward of the cylindrical axis.

In another example, a commercial form of roller (see U.S. Pat. No. 3,123,080) includes a cylinder of woven fabric from which monofilamentary elements project which are formed as loops cut at their apices. The resulting bristles emerge from the fabric in pairs, each pair emerging at virtually the same spot. They are of "partial elliptical shape" and resemble face-to-face parentheses, thus: (). Retention of such bristles in the hair is poor, and there is a conflict between making such bristles stiff enough to be forced into the hair yet not so stiff as to be irritating when pressed against a wearer's scalp or when being handled.

An object of this invention resides in providing a novel hair roller that is economical and practical to produce, combining desirable properties of a self-retaining roller.

SUMMARY OF THE INVENTION

Novel hair rollers have resilient monofilaments formed as detents projecting in pairs from a self-supporting cylinder wall. The detents individually have an upstanding leg and a short overhang which are divided from each other by a distinct bend. The overhang projects from the leg so as to be disposed over an opposite area of the cylinder wall. The pairs of detents have their legs firmly secured and upstanding from the solid (non-woven) plastic cylinder, emerging at sites spaced apart by the combined lengths of their overhangs. The overhangs of each pair extend from respective legs toward each other, but their ends are spaced apart. There is no problem of eliminating stubs (Simon) since no stubs are formed in the manufacturing process. The spaced-apart confronting pairs of detents provide dependable retention in the hair, yet are dependably easy to remove. The ends of all the bristles are bent-over and thus do not cause irritation to the user's hands or scalp.

The illustrative embodiment of the invention described in detail below and shown in the accompanying drawings includes some subsidiary features in common with known hair rollers, especially as in Simon, supra. The subsidiary features contribute to the highly effective properties of the novel rollers. Thus, the illustrative embodiment has a wall of solid material which is more easily kept clean than fabric with its interstices, and the solid plastic wall simplifies imparting a stable orientation to the filamentary detents. The manner of distribution of the detents over the surface of the roller, and the direction of the detent overhangs in relation to the hair that is wound about the roller, are considerations affecting the effectiveness of the roller. The monofilament detents are distributed in spirals about the cylindrical wall. This distribution of the detents enhances the probability of the detents being engaged by hair wound about the roller. The wound strands of hair extend along circles that are inherently identified with planes perpendicular to the cylindrical axis ("transverse planes"). Consequently, the strands of hair wound against the cylinder wall must engage the spiral distribution of detents. Moreover, the overhangs of the detents slant in relation to the transverse planes and this, too, promotes retentive engagement of the detents with the hair.

These features are included in the preferred embodiment of the novel hair rollers, which are free of sharp potentially annoying stubs, and can securely engage the wound hair and which nevertheless can be readily removed from the hair deliberately without snagging. Every bristle has an overhang, so that pressure of the bristles against the user's hands or scalp is not irritating.

The nature of the invention including the foregoing and other features and advantages will be more fully understood and appreciated from the following detailed description of the illustrative embodiment which is shown in the accompanying drawings.

THE DRAWINGS

FIG. 1 is a lateral view of a novel hair roller as an illustrative embodiment of the invention;

FIG. 2 is an end view of FIG. 1;

FIG. 3 is a greatly enlarged front view of a fragment of the hair roller of FIG. 1 near the center of that Figure;

FIG. 4 is a greatly enlarged fragmentary cross-section of the hair roller of FIG. 1 as seen from the plane 4—4 in FIG. 3;

FIG. 4*a* is a vastly enlarged lateral view of a typical end of a hair detent;

FIG. 5 is a greatly enlarged fragmentary cross-section of a flat strip of material used in making the hair roller of FIGS. 1 and 2 during manufacture of such strip of material, this view being taken perpendicular to the base material and along a filament embedded therein;

FIG. 6 is a greatly enlarged fragmentary cross-sectional view like FIG. 5 of a flat strip of material ready for use in making the hair roller of FIGS. 1 and 2;

FIG. 7 is a greatly enlarged fragmentary plan view of the flat strip of FIG. 6.

In FIGS. 1 and 2, the hair roller illustrated includes a cylindrical wall 10 and helical rows 12 of pairs of hair detents 14 distributed successively along helical files 16 around wall 10. Wall 10 is self-sustaining but resilient, so as to yield but not collapse in the ordinary use of the hair roller. Each hair detent (FIGS. 3 and 4) includes an upstanding portion or leg 14*a* that projects from wall 10 and an overhang 14*b* extending from portion 14*a* at an angle such that overhang 14*b* extends roughly parallel to an opposite portion of wall 10.

The overhangs 14*b* of each of the pairs of detents typically are spaced apart. Any small segment of spiral file 16 (FIG. 3) slants prominently in relation to a transverse plane, that is, a plane perpendicular to the axis of the roller. This plane is significant in the use of the hair roller, since each strand of hair extends in such a plane as the hair is being wound on the roller. That significance is discussed below. As viewed in FIG. 3, overhangs 14*b* slant at approximately the same angle to such a transverse plane. The upstanding portions or legs 14*a* of each pair of detents are spaced apart substantially, so that a space is defined by each pair of detents for containing strands of hair. There is also a relatively large separation between each leg 14*a* of a detent 14 of one pair and the leg 14*a*′ (FIGS. 3 and 4) of the next adjacent detent of another pair of detents along file 16.

The presently preferred method of making the hair roller of FIGS. 1–4 is as follows.

Many parallel, coplanar, mutually spaced apart monofilaments of thermoplastic material, especially nylon, are bent into undulations having oppositely directed alternating first and second series of loops. Each loop includes two legs and a bridge interconnecting the legs with a prominent bend between each leg and the bridge. In FIG. 5 there are three sets of bars I, II and III that form the undulations. After the bending operation, bars II are retracted slightly from the bridging portions Fc of the first loops. The plastic which is to form wall 10 is then cast or poured on the collective surfaces of bars I and II as is illustrated at the left in FIG. 5. Ribs R are formed in the narrow spaces between each bar I and the next bar II. Bridge portions Fc become immersed or totally embedded. The relationship of bars I, II and III at the left in FIG. 5 is maintained as the plastic B cools and solidifies. The series of loops projecting out of the base B comprise upstanding legs Fa and bridge portions Fb′. After base B has become firm or solidified, bars II and III are removed. As indicated at the right in FIG. 5, heated parting blades IV are then pressed toward grooved bars I, to part bridges Fb′ at their mid-points, yielding overhangs Fb (FIGS. 6 and 7). The heat-severing operation produces a slight knob (FIG. 4*a*) at the tip of the parted monofilament. The knobs have a smooth "heat-polished" finish when proper attention is given to the severing conditions. Thereafter bars I are pulled free of the paired rows of detents Fa, Fb. As seen in FIG. 7, the resulting continuous ribbon has pairs of projecting detents whose overhangs Fb are separated by small spaces, and the overhangs extend regularly along the ribbon. Ribs R (FIG. 6) which develop in the limited space between bars I and II contribute to the stable attitudes of legs Fa.

As is customary, the hair roller has many holes H through the wall (FIG. 1) to promote drying of wound hair. These holes are made in a punching operation while the material is still in the form of a ribbon. The regular attitudes of all the detents as described above may be disturbed somewhat by strippers presently used in withdrawing the punches from the ribbon just after the holes are punched. This deformation of the detents does not noticeably affect the performance of the detents.

The ribbon of FIGS. 5 and 6 is shaped into a spiral so that the edges of the base material are in abutment. The abutting spiral edges 10 are united by heat or through use of a solvent or a cement, thus producing tubing, and this tubing is cut into short lengths to yield the hair rollers of FIGS. 1 and 2. Legs Fa and overhangs Fb of the ribbon become legs 14*a* and overhangs 14*b* of the completed hair roller. When the flat ribbon of FIGS. 6 and 7 is curved to form the roller of FIGS. 1 and 2, the upstanding legs 14*a* become slightly tilted apart (FIG. 4). This effect on legs 14*a* causes overhangs 14*b* to become separated farther apart than in FIGS. 6 and 7. Additionally, since the overhangs 14*b* of each pair are not constrained to remain in alignment after the severing operation, they tend to become slightly skewed (FIG. 3) when the ribbon is formed into a spiral. The curving and the spiralling contribute to the increased space that develops between the knobs of each pair of detents when the ribbon is formed into the roller of FIG. 1.

The following are details of eminently successful examples of hair rollers made as described above. Parallel monofilaments of about 0.006-inch diameter nylon are spaced apart about 0.048 or 0.060-inch, and formed into undulations. One series of loops are set into solid nylon base material of about 0.07-inch average thickness. The nylon base and filaments resist damage and retain their shape when the hair rollers are immersed in boiling water. In this example, each full undulation (FIG. 5) including two legs Fa, a bridge Fb and a base portion Fc is about 0.248-inch long. The legs of a projecting loop are about 0.088-inch apart, measured to the axis of the filament. Legs Fa project about 0.08-inch from the base B. A hair roller made of such a ribbon, 2.0 inches wide in an example, is formed into a roller as described above. One size is one inch in diameter by 2½ inches long. In this size of roller, the spiral 18 extends approximately 360° around the roller axis. Mutually perpendicular files 16 and rows 12 (FIG. 3) in this size of hair roller extend at about 45° to a plane containing the axis of the roller, this angle being measured where the plane intersects the wall of the roller. The same 2-inch wide ribbon material has been used in making highly effective rollers of the usual range of lengths and the usual range of diameters of ⅝ inch to 2 inches. In all such rollers, the files 16—and correspondingly the overhangs 14*b*—extend at a prominent slant angle to the horizontal as viewed in FIG. 3. This "horizontal" corresponds to the attitude of the strands of hair when wound on the roller. Each strand lies essentially in a plane perpendicular to the axis of the roller.

The monofilament detents are form-retaining, being much stiffer than human hair, and yet they are so resilient as to yield to light finger pressure. Because of this resilience, hair that is wound about the roller tends to become engaged releasably with the pairs of detents, holding the roller wound in a lock of hair. The hair as it is being wound lies in planes perpendicular to the axis of the roller, and because the detents are distributed along spiral files 16 (FIGS. 1 and 3) there is a high degree of certainty that strands of hair wound against the roller will engage hair detents. Moreover, because the overhangs 14*b* slant prominently along files 16, the strands of hair tend to engage the overhangs at a slant angle (about 45° in the above example) and this engagement tends to deflect each overhang momentarily. (A like effect would occur with files 16 extending along the roller.) When hair has been wound on the roller, the pairs of detents releasably embrace strands of hair. There is no need for clips or other fasteners to hold the hair wound on the roller. The roller is comfortable to the wearer even when the wearer's head presses against a pillow. There is no concern for annoyance that might be caused by other rollers having short filaments (possibly sharp-ended filaments) directed outward of the wall of the roller toward the wearer's scalp. There are no bristles with outward-directed ends to irritate a user's hands.

The foregoing illustrative embodiment of the invention is subject to a latitude of modification and rearrangement by those skilled in the art. Consequently, the invention should be construed broadly in accordance with its true spirit and scope.

What is claimed is:

1. A hair roller including a cylindrical wall of solid plastic material and numerous pairs of hair detents, each said hair detent being a resilient monofilament having an end portion embedded securely in the cylindrical wall, each said monofilament detent being divided by a bend into an upstanding leg projecting from said cylindrical wall and an overhang extending from said upstanding leg to a free end, end portions of the hair detents of each pair emerging from the cylindrical wall at sites spaced apart by a distance approximately equal to the combined lengths of their overhangs and each pair of said overhangs extending from the legs thereof generally toward each other but being spaced apart, the spaces generally bounded by each pair of legs and the overhangs extending therefrom and the portion of the cylindrical wall between said pair of legs being free of elements projecting from the cylindrical wall.

2. A hair roller in accordance with claim 1, wherein said pairs of detents are distributed about the cylindrical wall along many spirals parallel to each other, and wherein said overhangs slant in relation to planes perpendicular to the cylindrical axis, whereby when hair is being wound on the roller, many strands of hair tend to lie in said planes and to engage the pairs of detents at slant angles to the overhangs, tending to deflect the overhangs momentarily and tending to become releasably captive under the paired overhangs.

3. A hair roller in accordance with claim 1 wherein said pairs of detents are distributed about the cylindrical wall along many spiral files parallel to each other, the pairs of overhangs thereof being approximately aligned with such files, and the pairs of detents being distributed along many spiral rows that intersect said spiral files at right angles.

4. A hair roller in accordance with claim 1 wherein said detents result from the process of bending many parallel mutually spaced-apart thermoplastic monofilaments into undulations having first and second alternating oppositely directed loops comprising upstanding legs and bridging portions, forming molten thermoplastic material into a strip with the bridging portions of the first loops entirely embedded in the strip, and heat-severing the second loops at substantially the midpoints of said second loops.

5. A hair roller in accordance with claim 1 wherein said overhangs bear slight knobs but are otherwise free of reserve bends at the free ends thereof.

6. A hair roller in accordance with claim 1, wherein the length of each of said legs is roughly equal to the distance between each pair of legs.

7. A hair roller in accordance with claim 1, wherein said monofilaments are of about 0.006 inch diameter, wherein said legs are about 0.08 inch long and the legs of each pair emerge from the cylindrical wall about 0.088 inch apart.

* * * * *